US011629527B2

(12) United States Patent
Hsu

(10) Patent No.: US 11,629,527 B2
(45) Date of Patent: Apr. 18, 2023

(54) LATCH CONTROL DEVICE

(71) Applicant: I-TEK METAL MFG. CO., LTD, Tainan (TW)

(72) Inventor: Wei-Chung Hsu, Tainan (TW)

(73) Assignee: I-TEK METAL MFG. CO., LTD, Tainan (TW)

( * ) Notice: Subject to any disclaimer, the term of this patent is extended or adjusted under 35 U.S.C. 154(b) by 195 days.

(21) Appl. No.: 17/243,823

(22) Filed: Apr. 29, 2021

(65) Prior Publication Data

US 2022/0290465 A1 Sep. 15, 2022

(51) Int. Cl.

| | |
|---|---|
| ***E05B 63/00*** | (2006.01) |
| ***E05B 47/00*** | (2006.01) |
| ***E05B 65/10*** | (2006.01) |

(52) U.S. Cl.

CPC ..... *E05B 63/0069* (2013.01); *E05B 47/0001* (2013.01); *E05B 47/0047* (2013.01); *E05B 65/104* (2013.01); *E05B 2047/0067* (2013.01); *E05B 2047/0086* (2013.01)

(58) Field of Classification Search

CPC ..... E05B 47/0046; E05B 47/0047; E05B 2047/0067; E05B 2047/0068; E05B 65/10; E05B 65/104; E05B 65/108; E05B 15/0205; Y10T 292/68; Y10T 292/696; Y10T 292/699; Y10T 292/702; Y10S 292/65; Y10S 292/66; A62C 2/241

See application file for complete search history.

(56) References Cited

U.S. PATENT DOCUMENTS

| | | | | |
|---|---|---|---|---|
| 4,867,496 | A * | 9/1989 | Thomas | E05B 65/104 292/341.16 |
| 5,782,509 | A * | 7/1998 | Uyeda | E05B 65/104 70/DIG. 10 |
| 2003/0127869 | A1* | 7/2003 | Herron | E05B 47/0047 292/341.15 |
| 2019/0203503 | A1* | 7/2019 | Chang | E05B 47/0696 |
| 2019/0376316 | A1* | 12/2019 | Hsu | E05B 47/0047 |
| 2019/0376317 | A1* | 12/2019 | Hsu | E05B 63/24 |

FOREIGN PATENT DOCUMENTS

| | | | | |
|---|---|---|---|---|
| AU | WO 8800633 | A1 * | 1/1988 | E05B 47/0046 |
| EP | 1788169 | A1 * | 5/2007 | E05B 47/0047 |
| EP | 3805490 | A1 * | 4/2021 | E05B 17/007 |
| GB | 2572027 | A * | 9/2019 | E05B 15/022 |

* cited by examiner

*Primary Examiner* — Christine M Mills
*Assistant Examiner* — Christopher F Callahan
(74) *Attorney, Agent, or Firm* — Alan D. Kamrath; Karin L. Williams; Mayer & Williams PC

(57) ABSTRACT

A latch control device includes a connecting seat divided by two integrally formed walls into a hollow portion and a mounting portion spaced from the hollow portion. A detecting module is disposed between the two walls. A locking member is pivotably mounted between the two walls. A first restraining member is disposed in the mounting area and is configured to lock or unlock the locking member, controlling pivotal movement of the locking member. When the locking member is not pivotable, a latch of a door lock in the hollow portion is restrained in the hollow portion, preventing opening of a door to which the door lock is mounted. When the locking member is pivotable, the locking member can pivot while the door pivots, permitting opening of the door.

7 Claims, 13 Drawing Sheets

LATCH CONTROL DEVICE

BACKGROUND OF THE INVENTION

The present invention relates to a latch control device and, more particularly, to an latch control device that can be directly applied to a current mechanical lock to provide electric control of a latch of the mechanical lock.

A door lock is mounted to a door to pivot together with the door relative to a door frame. The door frame includes a fixed latch hole which receives a latch of the door lock when the door is closed, such that the door cannot be opened before retracting the latch out of the latch hole. Furthermore, when the door lock is in a locking state, a key is required to unlock the door lock for subsequently retracting the latch.

With the progress of technology, more and more electric door locks are applied to doors. An electric door lock can cooperate with a door access card, a mobile phone, or other electronic devices to proceed with locking or unlocking operation. However, replacement of an entire mechanical door lock already mounted to a door is required if it is desired to electrically control opening and closing of the door. As a result, the conventional mechanical door locks cannot be used.

BRIEF SUMMARY OF THE INVENTION

To solve the above disadvantages, the present invention provides a latch control device including:

a connecting seat including a first surface and two walls integrally extending perpendicularly from the first surface along a first axis, wherein the two walls are spaced from each other along a second axis perpendicular to the first axis, wherein a first notch and a second notch are formed between the two walls and are spaced from each other along a third axis perpendicular to the first and second axes, wherein a hollow portion is formed at an inner side of the two walls, and wherein a mounting portion is provided at an outer side of the two walls;

a detecting module securely disposed in the first notch, wherein the detecting module includes an actuation member having an outer end located in the hollow portion, wherein the actuation member is configured to detect whether a latch of a door lock is in the hollow portion;

a locking member including an axle coupling portion and an arm extending from the axle coupling portion, wherein the locking member is pivotable about a pivotal axis parallel to the second axis between a closure position closing the second notch and an open position revealing the second notch;

a driving device securely disposed in the mounting portion of the connecting seat;

a first restraining member coupled to the driving device, wherein the first restraining member is actuatable by the driving device between a locking position preventing pivotable movement of the locking member and an unlocking position permitting pivotable movement of the locking member, wherein the latch is restrained in the hollow portion by the first restraining member in the locking position; and a safety pin unit disposed in the mounting portion of the connecting seat, wherein the safety pin unit includes a stop pin, wherein when a fire occurs, the stop pin engages with the arm of the locking member to prevent the locking member from pivoting from the closure position to the open position, and wherein when no fire occurs, the stop pin is spaced from the arm of the locking member.

The two walls and the detecting module together divide the connecting seat into the mounting portion and the hollow portion independent from the mounting portion, such that the hollow portion that can be exposed via the opening is separate from the mounting portion in which components are mounted. This can effectively protect the components of the latch control device from being destroyed, increasing the safety.

In an example, each of the two walls has L-shaped cross sections and includes a horizontal section and a vertical section connected to the horizontal section. The first notch is located between the vertical sections of the two walls. The second notch is located between two ends respectively of the horizontal sections of the two walls distant to the vertical sections.

In an example, the safety pin unit includes:

a body securely disposed on the first surface of the connecting seat, wherein the body includes a mounting hole extending along the second axis, wherein the mounting hole includes a first hole section and a second hole section having an inner diameter lamer than an inner diameter of the first hole section;

a low melting point member received in the second hole section, wherein the low melting point member has an outer diameter larger than the inner diameter of the first hole section and smaller than the inner diameter of the second hole section, wherein a melting point of the stop pin is higher than a melting point of the low melting point member, wherein the stop pin includes a pin body and an enlarged portion on an end of the pin body, wherein the pin body has an outer diameter smaller than the inner diameter of the first hole section, and wherein the enlarged portion has an outer diameter larger than the inner diameter of the first hole section and smaller than the inner diameter of the second hole section;

a plug securely disposed to an end of the second hole section distant to the first hole section; and a spring disposed between the plug and the enlarged portion of the stop pin, wherein the spring biases the stop pin, wherein the arm extends outward in a radial direction of the axle coupling portion, wherein when no fire occurs, the stop pin remains in an inner side of the body, and wherein when the low melting point member melts under a fire, the spring biases the pin body of the stop pin to extend beyond the body to engage with the arm.

Each arm of the locking member cooperates with a respective safety pin unit to prevent the locking member from pivoting from the closure position to the open position during a fire, effectively stopping spread of fire.

In an example, the detecting module includes a bracket, the actuation member, and a door closure detecting unit. The bracket is securely disposed in the first notch between the two walls. The bracket includes a mounting wall. The actuation member is pivotably connected to the mounting wall of the bracket. The actuation member includes an inner end and an outer end. The actuation member is pivotable between a door closing position and a door opening position. The door closure detecting unit is mounted to a side of the mounting wall. The inner end of the actuation member is configured to actuate the door closure detecting unit. When the actuation member is in the door closing position, the inner end of the actuation member is in one of a first mode actuating the door closure detecting unit and a second mode not actuating the door closure detecting unit. When the actuation member is in the door opening position, the inner end of the actuation member is in another of the first mode actuating the door closure detecting unit and the second mode not actuating the door closure detecting unit.

In an example, the latch control device further includes a mounting seat and a door detecting unit. The mounting seat includes a first part parallel to the first surface and two second parts extending perpendicularly to the first part. The driving device is securely disposed between the two second parts. The first restraining member is slidably mounted to the first part, wherein the first restraining member further includes a leg extending perpendicularly to a displacement direction of the first restraining member. The door detecting unit is securely disposed on one of the two second parts and located adjacent to the leg. When the first restraining member is in the locking position, the leg is in one of a first mode actuating the door detecting unit and a second mode not actuating the door detecting unit. When the first restraining member is in the unlocking position, the leg is in another of the first mode actuating the door detecting unit and the second mode not actuating the door detecting unit.

In an example, the latch control device further includes a positioning member. The connecting seat includes first and second pivotal portions formed on the first surface and located in the mounting portion. The locking member includes an abutting side on the axle coupling portion. The axle coupling portion is pivotably connected to the first pivotal portion. The positioning member is pivotably connected to the second pivotal portion. The positioning member includes a limiting end and a groove spaced from the limiting end in a circumferential direction about a pivotal axis defined by the second pivotal portion. The limiting end abuts against the abutting side. The first restraining member includes a first stop arm extending along the third axis. When the first restraining member is in the locking position, the first stop arm is spaced from the groove along the second axis and is located between the positioning member and the mounting seat along the second axis, such that the positioning member is not pivotable to prevent the locking member from pivoting from the closure position to the open position. When the first restraining member is in the unlocking position, the first stop arm is aligned with the groove along the second axis, and the positioning member is pivotable to allow pivotal movement of the locking member from the closure position to the open position.

In an example, a bias spring is disposed between the positioning member and the connecting seat. The connecting seat further includes a slot defined in the first surface and extending along the third axis. The positioning member further includes a pressing end located between the groove and the limiting end in the circumferential direction about the pivotal axis defined by the second pivotal portion. An end of the bias spring is coupled with the pressing end. Another end of the bias spring is received in the slot. When the positioning member pivots, the end of the bias spring slides in the slot along the third axis.

In an example, the first stop arm is U-shaped and includes two distal ends. When the first restraining member is in the locking position, the two distal ends of the first stop arm are misaligned from the groove of the positioning member along the second axis and are located between the positioning member and the mounting seat along the first axis. When the first restraining member is in the unlocking position, one of the two distal ends of the first stop arm is aligned with the groove along the second axis, and another of the two distal ends of the first stop arm is located on an outer side of the positioning member.

The U-shaped first and second stop arms can more stably prevent rotation of the two positioning members. Furthermore, even if the first and second stop arms are located in the locking position and when the door is pushed to impart a larger torque to the two positioning members squeezing the first and second stop arms, the first and second stop arms are less likely to deform.

The present invention will become clearer in light of the following detailed description of illustrative embodiments of this invention described in connection with the drawings.

Figure 1:
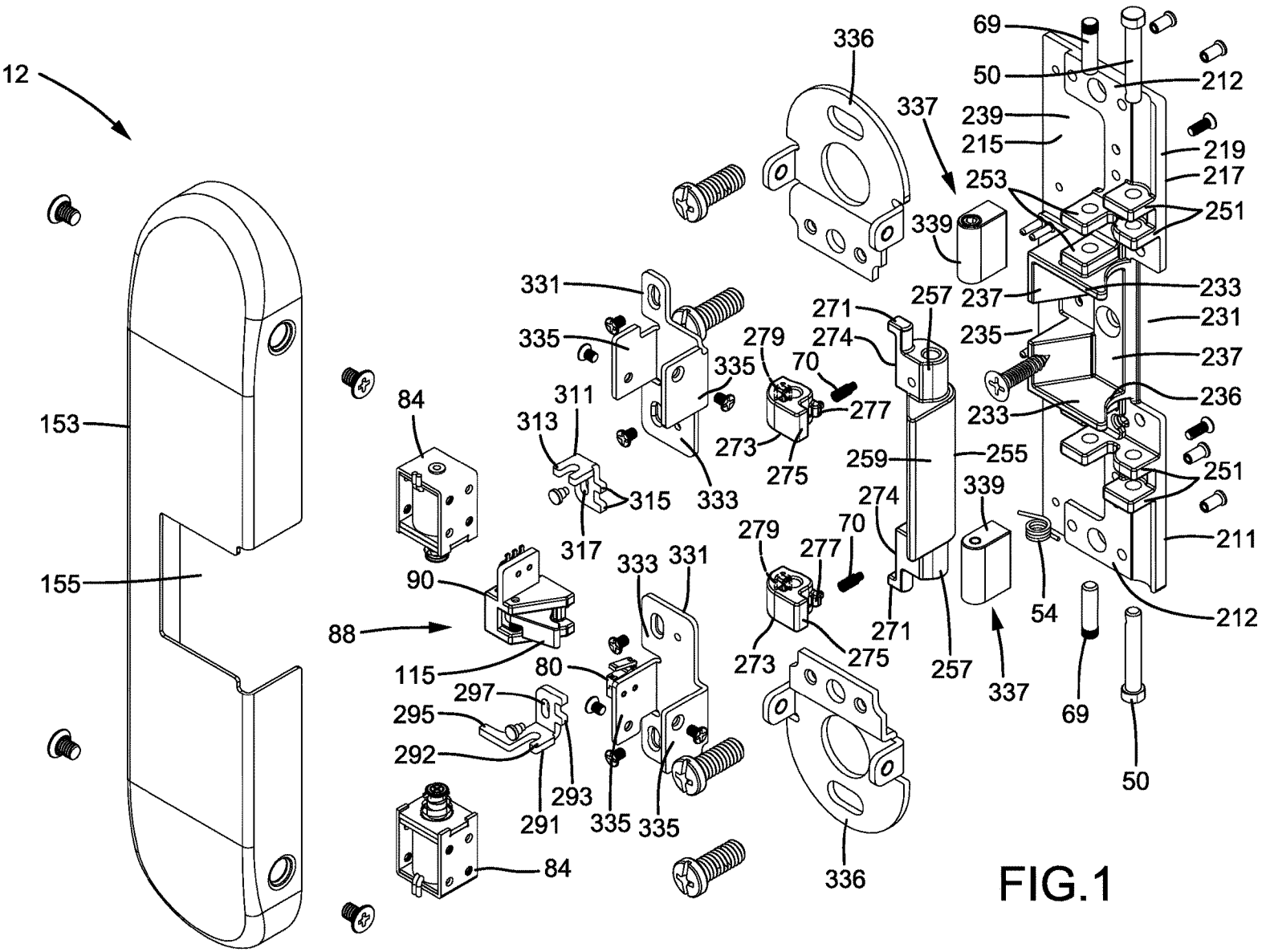
FIG. 1 is an exploded, perspective view of a latch control device according to the present invention.

All figures are drawn for ease of explanation of the basic teachings of the present invention only; the extensions of the figures with respect to number, position, relationship, and dimensions of the parts to form the embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "inner", "outer", "side", "end", "portion", "section", and similar terms are used herein, it should be understood that these terms have reference only to the structure shown in the drawings as it would appear to a person viewing the drawings and are utilized only to facilitate describing the invention

DETAILED DESCRIPTION OF THE INVENTION

Figure 5:
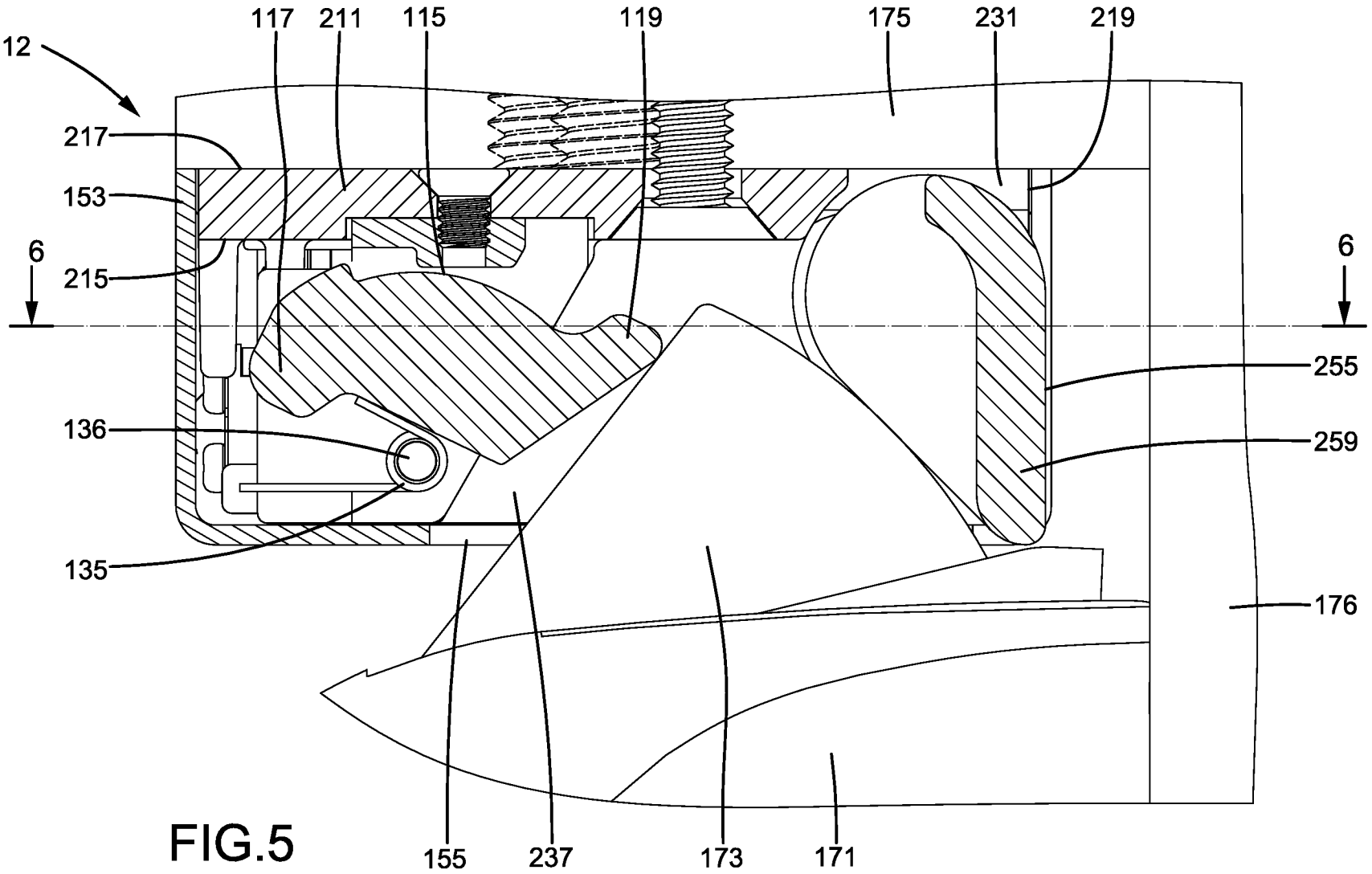
FIG. 5 is a cross sectional view taken along section line 5-5 of FIG. 4, with the latch control device fixed to a door frame to which a door with a door lock is mounted.

A latch control device 10 according to the present invention is securely mounted to a door frame 175 to restrain or release a latch 173 of a door lock 171 mounted to a door 176 pivotably mounted to the door frame (FIG. 5). With reference to FIG. 1, the latch control device 12 includes a connecting seat 211 having a first surface 215 and a second surface 217 opposite to the first surface 215. The connecting seat 211 further includes an outer side 219 extending between the first surface 215 and the second surface 217. The connecting seat 211 further includes two walls 233 integrally extending perpendicularly from the first surface 215 along a first axis. The two walls 233 are spaced from each other along a second axis perpendicular to the first axis. A first notch 235 and a second notch 236 are formed between the two walls 233 and are spaced from each other along a third axis perpendicular to the first and second axes. Each of the two walls 233 has substantially L-shaped cross sections and includes a horizontal section and a vertical section connected to an end of the horizontal section. The first notch 235 is located between the two vertical sections of the two walls 233. The second notch 236 is located between the other ends of the two horizontal sections distant to the vertical sections. A hollow portion 237 is formed at an inner side of the two walls 233. A mounting portion 239 is provided at an outer side of the two walls 233. The connecting seat 211 further includes a side opening 231 extending from the outer side 219 to the second notch 236 and extending in a direction parallel to the third axis. The connecting seat 211 further includes two first pivotal portions 251 located in the mounting portion 239 and spaced from each other along the second axis and two second pivotal portions 253 located in the mounting portion 239 and spaced from each other along the second axis. The two second pivotal portions 253 are contiguous to outer sides of the two walls 233 and are spaced from the two first pivotal portions 251 along the third axis. The connecting seat 211 further includes a slot 254 (FIG. 7) in the first surface 215 and extending along the third axis.

The latch control device 12 further includes a locking member 255 pivotally mounted to the connecting seat 211. The locking member 255 includes two axle coupling portions 257 spaced from each other along the second axis and two arms 271 extending from the two axle coupling portions 257, respectively. Each of the two arms 271 extends outwards from an associate axle coupling portion 257 in a radial direction and has substantially L-shaped cross sections. The locking member 255 further includes a gate section 259 extending between the two axle coupling portions 257.

Figure 6:
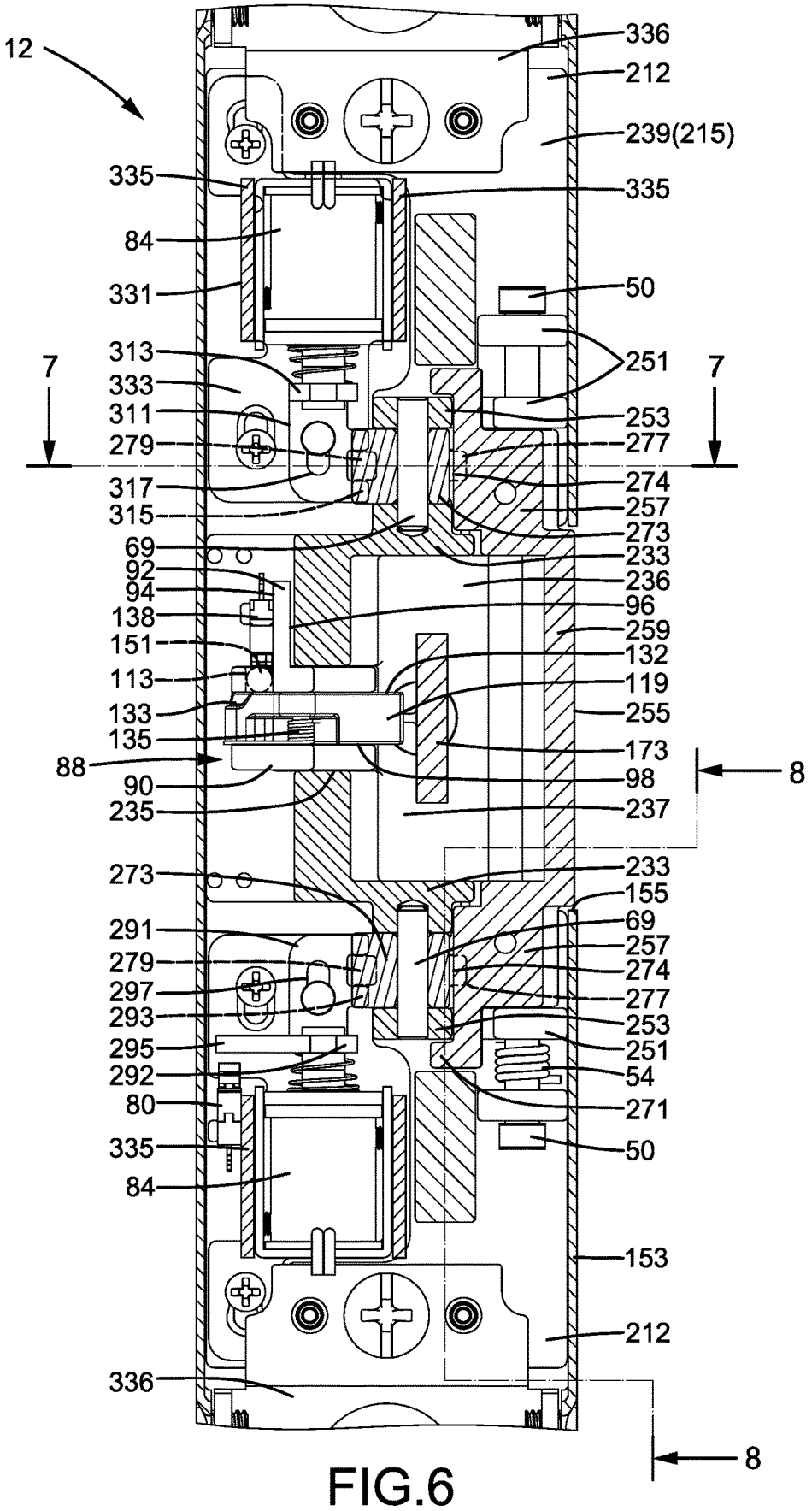
FIG. 6 is a cross sectional view taken along section line 6-6 of FIG. 5.
Figure 7:
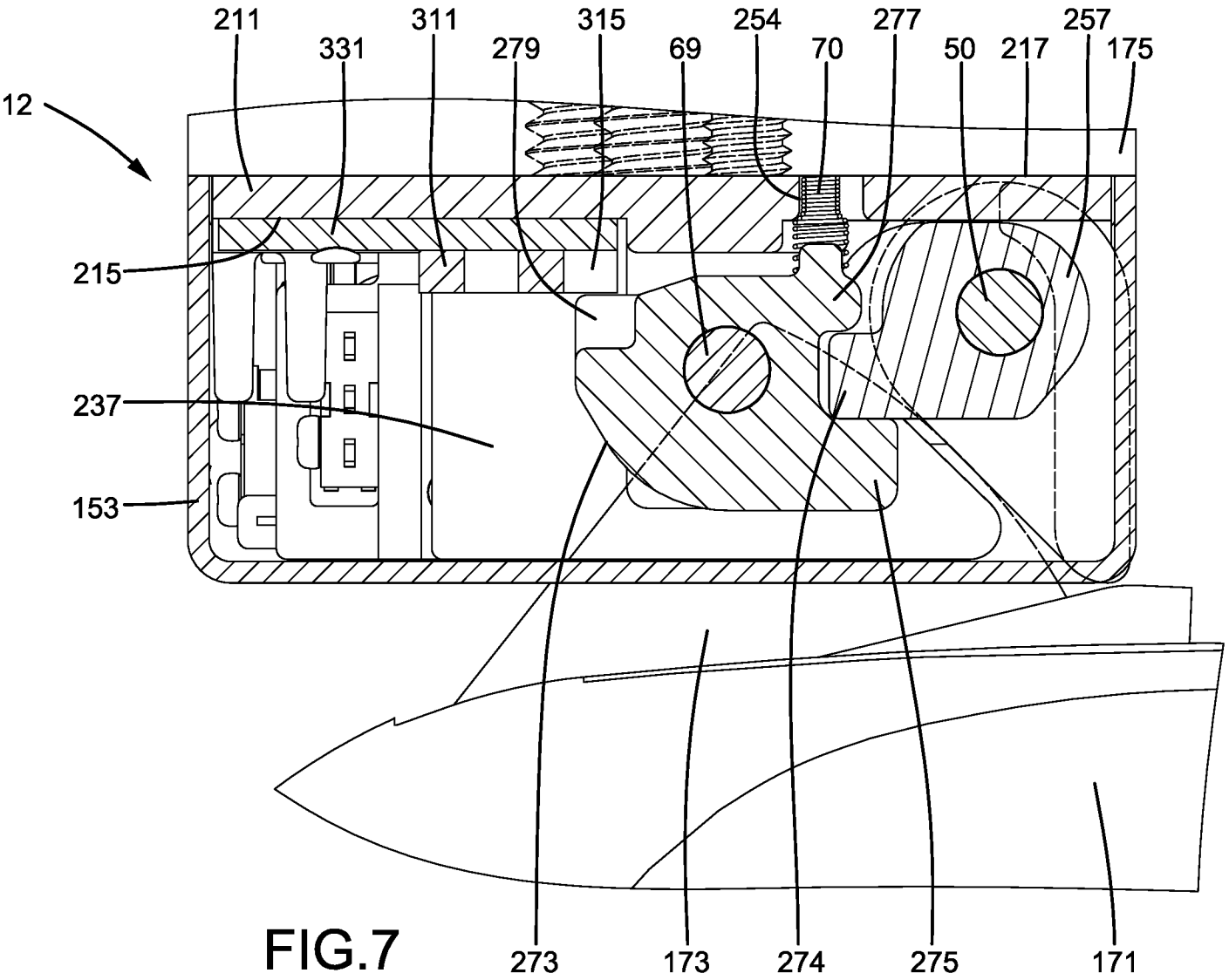
FIG. 7 is a cross sectional view taken along section line 7-7 of FIG. 6.
Figure 11:
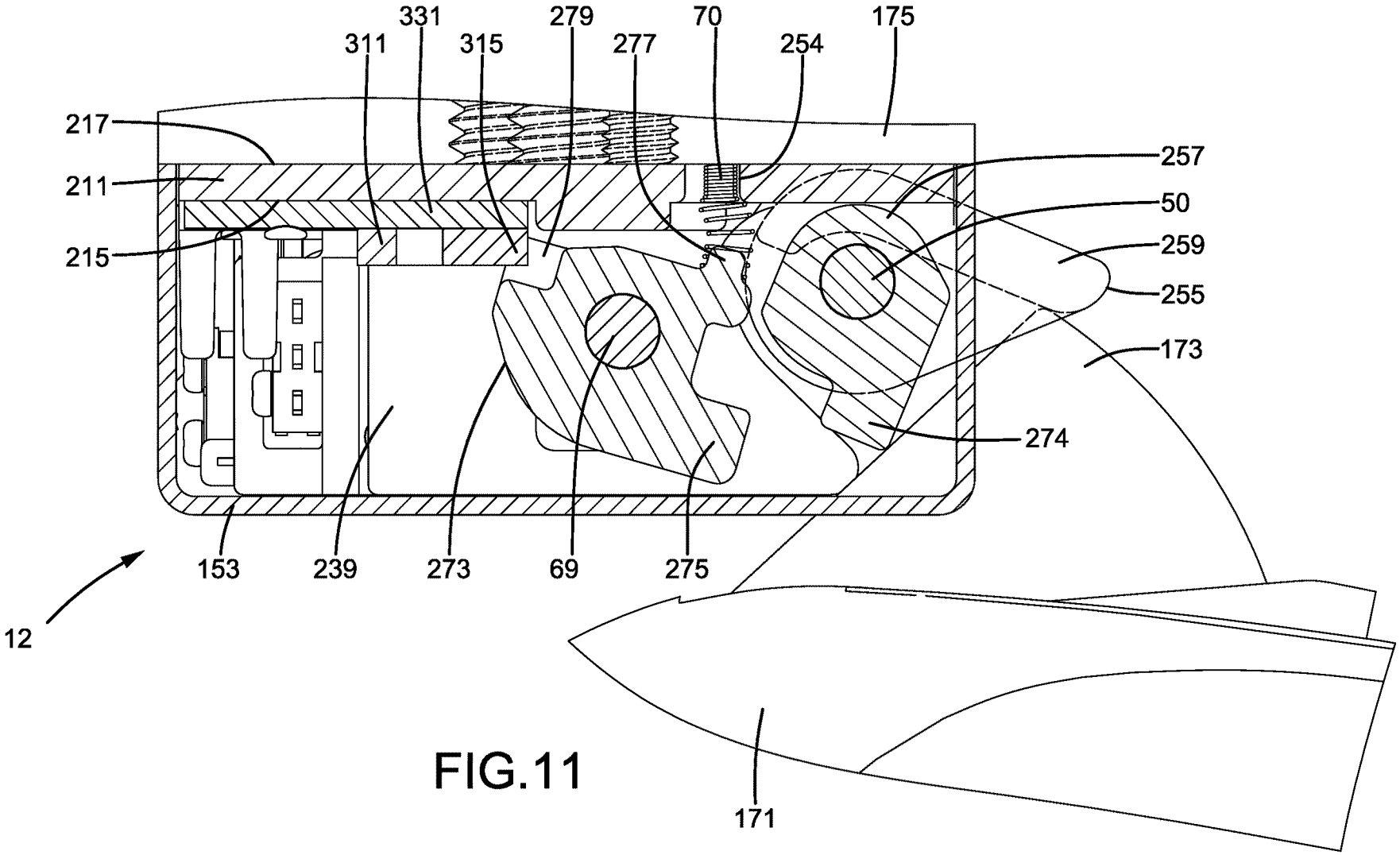
FIG. 11 is a cross sectional view illustrating the locking member in an open position.

With reference to FIGS. 1 and 6, the two axle coupling portions 257 of the locking member 255 are contiguous to the two first pivotal portions 251, respectively. Two first axles 50 extend through the two first pivotal portions 251 and the two axle coupling portions 257, respectively, providing pivotal connection. A return spring 54 is mounted around one of the two first axles 50 and an associated axle coupling portion 257. The locking member 255 is pivotable about a pivotal axis parallel to the second axis and is pivotable between a closure position (FIGS. 5 and 7) closing the second notch 236 and an open position (FIG. 11) revealing the second notch 236. The return spring 54 biases the locking member 255 towards the closure position. In the embodiment shown, locking member 255 pivots about the pivotal axis defined by the two first axles 50. When the locking member 255 is in the closure position, the hollow portion 237 is closed (FIG. 7). On the other hand, when the locking member 255 is in the open position, the hollow portion 237 is open (FIG. 11).

The latch control device 12 further includes two positioning members 273 pivotably connected to the two second pivotal portions 253, respectively. Each of the two positioning members 273 includes a limiting end 275 and a groove 279 spaced from the limiting end 279 in a circumferential direction about a pivotal axis defined by the two second pivotal portions 253. Each of the two positioning members 273 further includes a pressing end 277 located between the groove 279 and the limiting end 275 in the circumferential direction about the pivotal axis defined by the two second pivotal portions 253.

With reference to FIG. 7, two second axles 69 respectively extend through the two second pivotal portions 253 and respectively extend through the two positioning members 273. Each of the two positioning members 273 can pivot about a pivotal axis of the respective second axle 69. When the locking member 255 is in the closure position, the pressing end 275 of each of the two positioning members 273 abuts against an outer side of an abutting side 274 of a respective axle coupling portion 257 of the locking member 255. Specifically, each abutting side 274 of the locking member 255 is located between the limiting end 275 and the pressing end 277 of a respective positioning member 273. Each of the two positioning member 273 is driven to pivot when the locking member 255 pivots between the closure position and the open position. Two biasing springs 70 are provided. Each of the two biasing springs 70 is disposed between a respective positioning member 273 and the connecting seat 211 and includes an end connected to the pressing end 277 of the respective positioning member 273. The other end of each of the two biasing springs 270 is received in a respective slat 254. When each of the two locking members 273 pivots, the other end of a respective bias spring 70 slides in the respective slot 254 along the third axis.

The latch control device 10 further includes two mounting seats 331 each having a first part 333 parallel to the first surface 215 and two second parts 335 extending perpendicularly from two sides of the first part 333 and spaced from each other along the third axis. Each of the two second parts 335 is movably received in the mounting portion 239 of the connecting seat 211 along the second axis and are located on two sides of the two walls 233 along the second axis. Specifically, each of the two mounting seats 331 is screwed to the connecting seat 211 by a screw. When the screw is tightened, the respective mounting seat 331 is fixed. On the other hand, when the screw is loosened, the respective mounting seat 331 can move along the second axis. Furthermore, two driving devices 84 are provided, and each of the two driving devices 84 is disposed between the two parts 335 of one of the two mounting seats 331 and is preferably in the form of an electromagnetic valve. One of the two parts 335 of one of the two mounting seats 331 includes a door detecting unit 80 disposed thereon. The door detecting unit 80 can be a micro switch, a reed switch, a photoelectric switch, etc. In the embodiment shown, the door detecting unit 80 is disposed on a lower one of the two mounting seats 331 along the second axis.

The latch control device 12 further includes a first restraining member 291 and a second restraining member 311 connected to the two driving devices 84, respectively. The two driving devices 84 drive the first and second restraining members 291 and 311 to move in opposite directions parallel to the second axis. The first restraining member 291 includes a first stop arm 293 parallel to the first surface 215 and having U-shaped cross sections and a first connecting portion 292 extending perpendicularly to the first stop arm 293 and having U-shaped cross sections. The U-shaped first stop arm 293 includes two distal ends. A first track 297 is disposed on a side of the first stop arm 293 parallel to the first part 333 of a respective mounting seat 331. A length of the first track 297 along the second axis is equal to the displacement range of the first restraining member 291 along the second axis. A leg 295 extends from a side of the first connecting portion 292 and extends perpendicularly to the displacement direction of the first restraining member 291. In the embodiment shown, the leg 295 extends along the third axis.

The first connecting portion 292 of the first restraining member 291 is connected to and drivable by one of the two driving devices 84. The first stop arm 293 is slidably coupled to the respective mounting seat 331 on the respective driving device 84. In the embodiment shown, a pin extends through the first track 297 and is coupled with a respective first part 333. Thus, when the respective driving device 84 operates, the first restraining member 291 displaces in the extent of the first track 297. Furthermore, the U-shaped first stop arm 293 moves between the respective positioning member 273 and the first part 333 of the respective mounting seat 331 along the first axis.

The second restraining member 311 includes a second stop arm. 315 having substantially U-shaped cross sections and parallel to the first surface 215 and a second connecting portion 313 having substantially U-shaped cross sections and extending perpendicularly to the second stop arm 315. The U-shaped second stop arm 315 has two distal ends. A second track 317 is disposed on a side of the second stop arm 315 and extends parallel to the first part 33 of the other mounting seat 331. The second track 317 extends in a direction parallel to the second axis and has a length equal to the displacement range of the second restraining member 311.

The second connecting portion 313 of the second restraining member 311 is connected to and drivable by the other of the two driving devices 84. The second stop arm 315 is slidably coupled to the respective mounting seat 331 on the respective driving device 84. In the embodiment shown, a pin extends through the second track 317 and is coupled with a respective first part 333. Thus, when the respective driving device 84 operates, the second restraining member 311 displaces in the extent of the second track 317 along the third axis. Furthermore, the U-shaped second stop arm 315 is located between the respective positioning member 273 and the first part 333 of the respective mounting seat 331 along the first axis.

Figure 9:
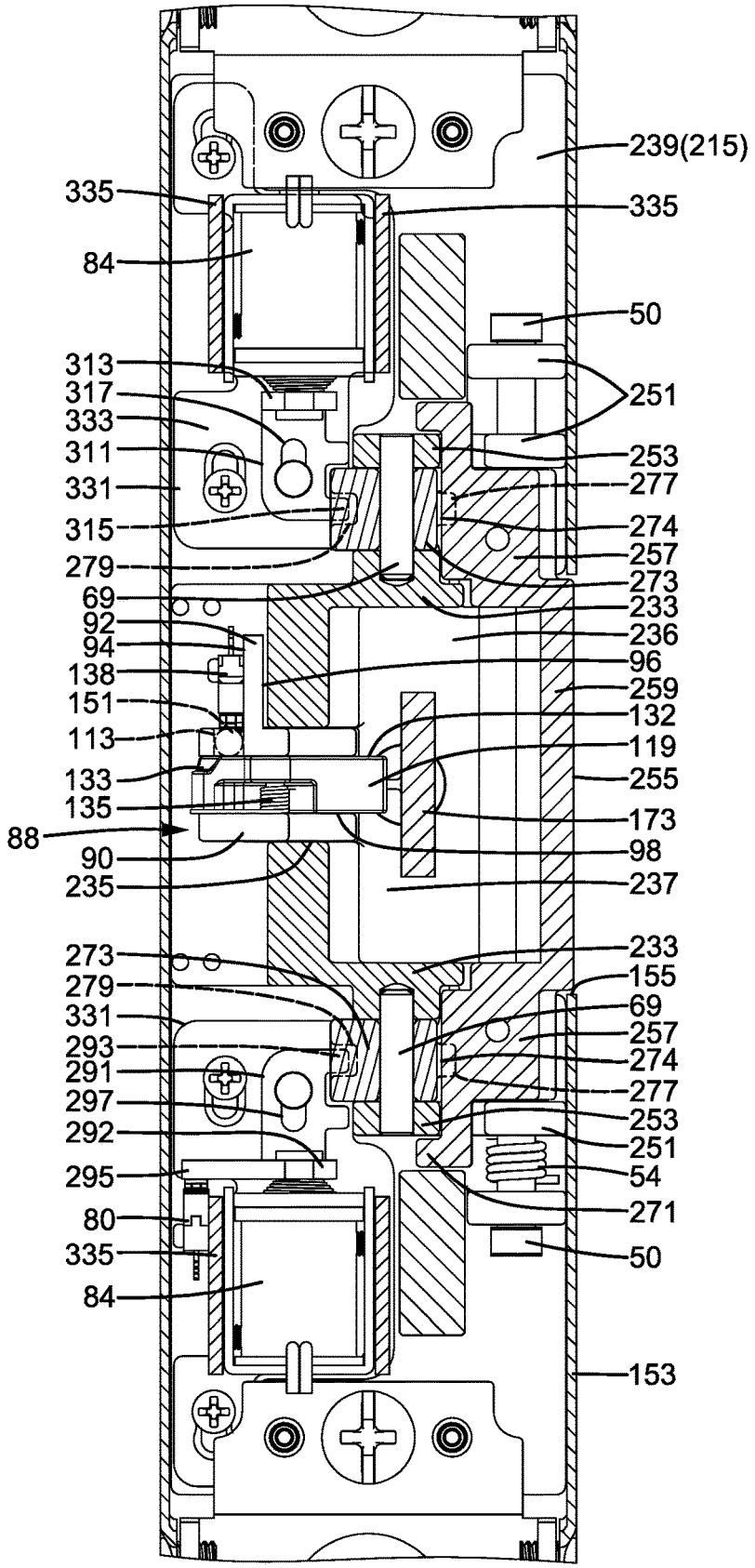
FIG. 9 is a view similar to FIG. 6 with two restraining members of the latch control device moved to a non-stopping position.

With reference to FIG. 6, when the first and second stop arms 293 and 315 of the first and second restraining members 291 and 311 are misaligned from the grooves 279 of the two positioning members 273 along the second axis, the first and second restraining members 291 and 311 are in a locking position. With reference to FIG. 9, when one of the two distal ends of each of the first and second stop arms 293 and 315 of the first and second restraining members 291 and 311 is aligned with the groove 279 of the respective positioning member 273 and when the other distal end of each of the first and second stop arms 293 and 315 of the first and second restraining members 291 and 311 is located at an outer side of the respective positioning member 273 along the second axis, the first and second restraining members 291 and 311 are in an unlocking position.

The disposition locations of the two mounting seats 311 on the connecting seat 211 are used to set the initial position (before being driven) of the first and second restraining members 291 and 311 to the locking position or the unlocking position, thereby setting the latch control device 12 to be in a normally open state or a normally closed state. In a case that the latch control device 12 is set to the normally open state, the initial position (before being driven) of the first and second restraining members 291 and 311 are the unlocking position. Namely, when the two driving devices 84 are not energized to drive the first and second restraining members 291 and 311, the first and second restraining members 291 and 311 remain in the unlocking position. When the two driving devices 84 are energized to drive the first and second restraining members 291 and 311, the first and second restraining members 291 and 311 remain in the locking position.

In another case that the latch control device 12 is set to the normally closed state, the initial position (before being driven) of the first and second restraining members 291 and 311 are the locking position. Namely, when the two driving devices 84 are not energized to drive the first and second restraining members 291 and 311, the first and second restraining members 291 and 311 remain the locking position. When the two driving devices 84 are energized to drive the first and second restraining members 291 and 311, the first and second restraining members 291 and 311 remain in the unlocking position. In the embodiment shown, the latch control device 12 is in a normally closed state.

Figure 3:
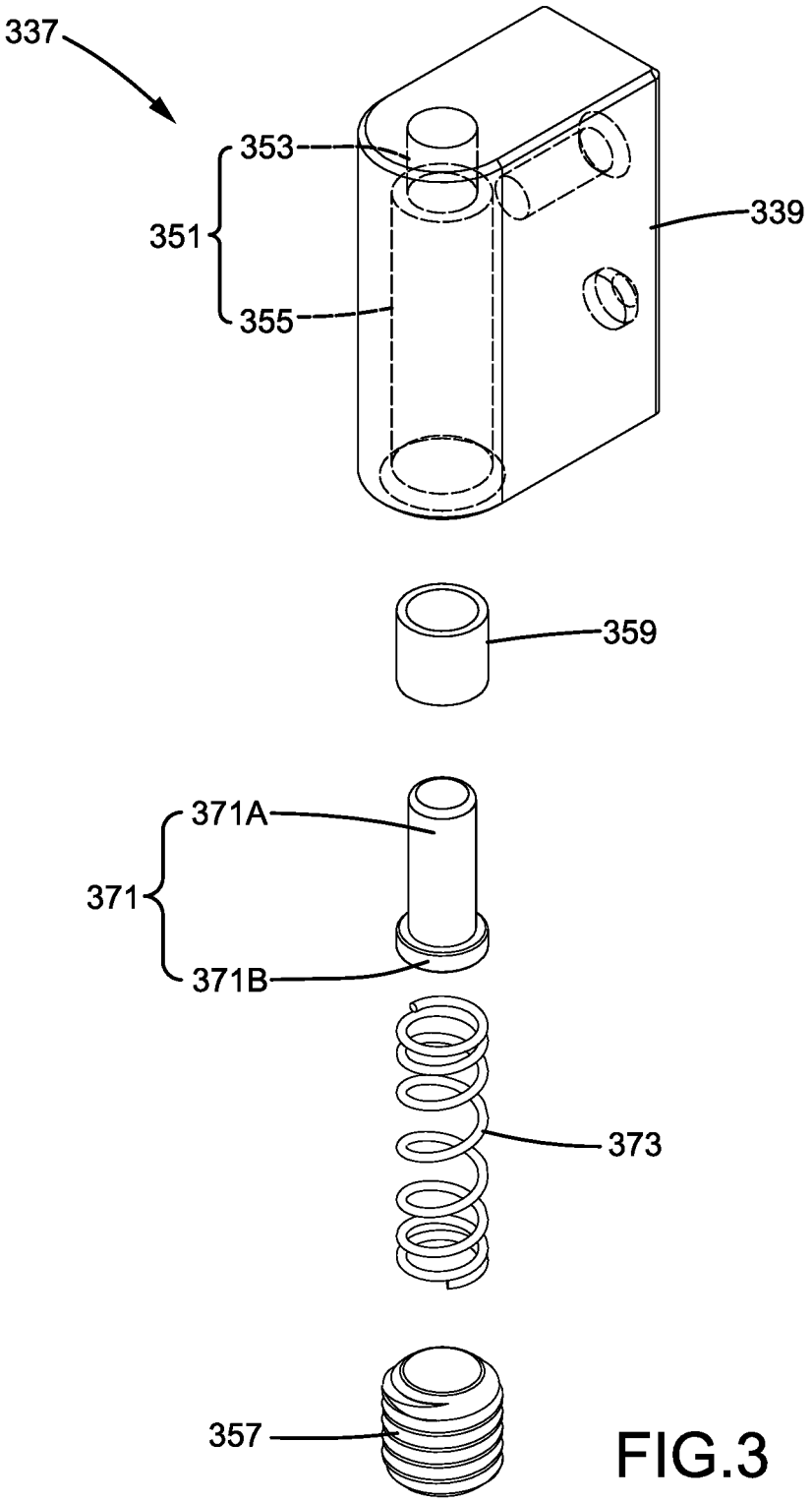
FIG. 3 is an exploded, perspective view of a safety pin unit of the latch control device of FIG. 1.
Figure 8:
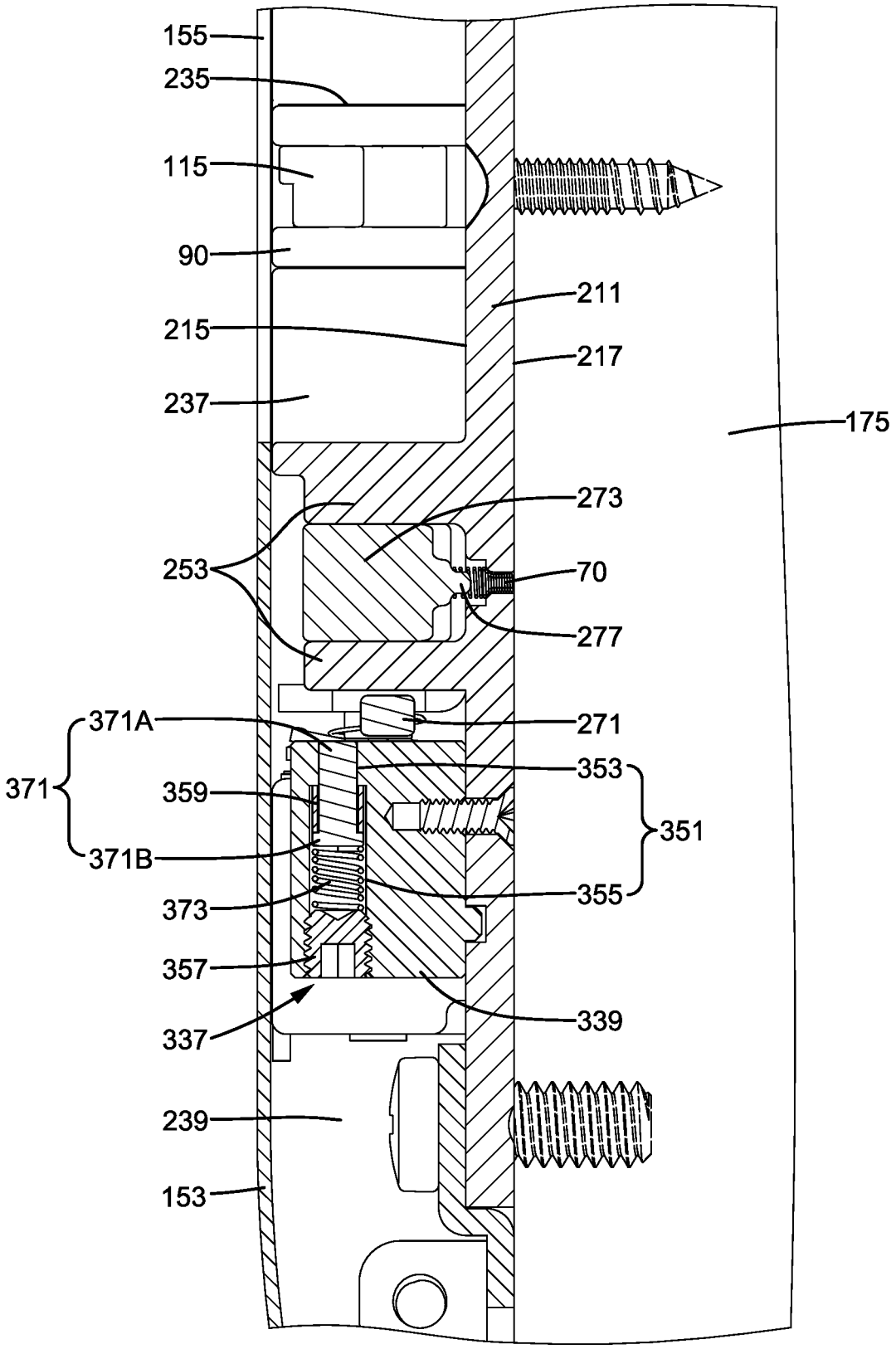
FIG. 8 is a cross sectional view taken along section line 8-8 of FIG. 6.

The latch control device 12 further includes two safety pin units 337 securely mounted to the mounting portion 239 of the connecting seat 211. With reference to FIGS. 3 and 8, each of the two safety pin units 37 includes a body 339 having a mounting hole 351 extending from a top face thereof along the second axis. Each mounting hole 351 includes a first hole section 353 and a second hole section 355 having an inner diameter larger than an inner diameter of the first hole section 353, forming a stepped portion at an intersection of the first hole section 353 and the second hole section 355. Each body 339 is securely mounted in the mounting portion 239 of the connecting seat 211. The two bodies 339 are symmetrically disposed outside of the two second pivotal portions 253 along the second pivotal portions 253.

Each of the two safety pin units 37 includes a low melting point member 359 made of a metal with a low melting point, such as a zinc alloy. Each low melting point member 359 is substantially cylindrical and has an outer diameter smaller than the inner diameter of the second hole section 355 but larger than the inner diameter of the first hole section 353. Each low melting point member 359 is received in a respective second hole section 355 and has an end abutting against the respective stepped portion.

Each of the two safety pin units 337 further includes a stop pin 371 having a melting point lower than that of the respective low melting point member 359. In an example, each stop pin 371 is made of a ferrous material. In the embodiment shown, each stop pin 371 includes a pin body 371A and an enlarged portion 371B on an end of the pin body 371A. The outer diameter of the pin body 371A is smaller than the inner diameter of the first hole section 353. The outer diameter of the enlarged portion 371B is larger than the outer diameter of the first hole section 353 and is smaller than the inner diameter of the second hole section 355. Each stop pin 371 is received in the mounting hole 351 of the respective body 339. The pin body 371A of each stop pin 371 extends through a respective low melting point member 359 and has a distal end received in the respective first hole section 353. The enlarged portion 371B of each stop pin 371 is received in the respective second hole section 355 (FIG. 8).

Each of the two safety pin units 337 further includes a spring 373 and a plug 357. Each of the springs 373 and the plugs 357 have a melting point higher than that of the low melting point member 359. In an example, the springs 373 and the plugs 357 are made of ferrous material. Each plug 357 has an outer threading and is in threading connection with an end of the respective second hole section 355 distant to the first hole section 353. Each spring 373 is received in a respective second hole section 355. Each spring 373 is located between the enlarged portion 371B of a respective stop pin 371 and a respective plug 357 along the second axis. Each spring 373 biases the respective stop pin 371 towards the first hole section 353.

Figure 2:
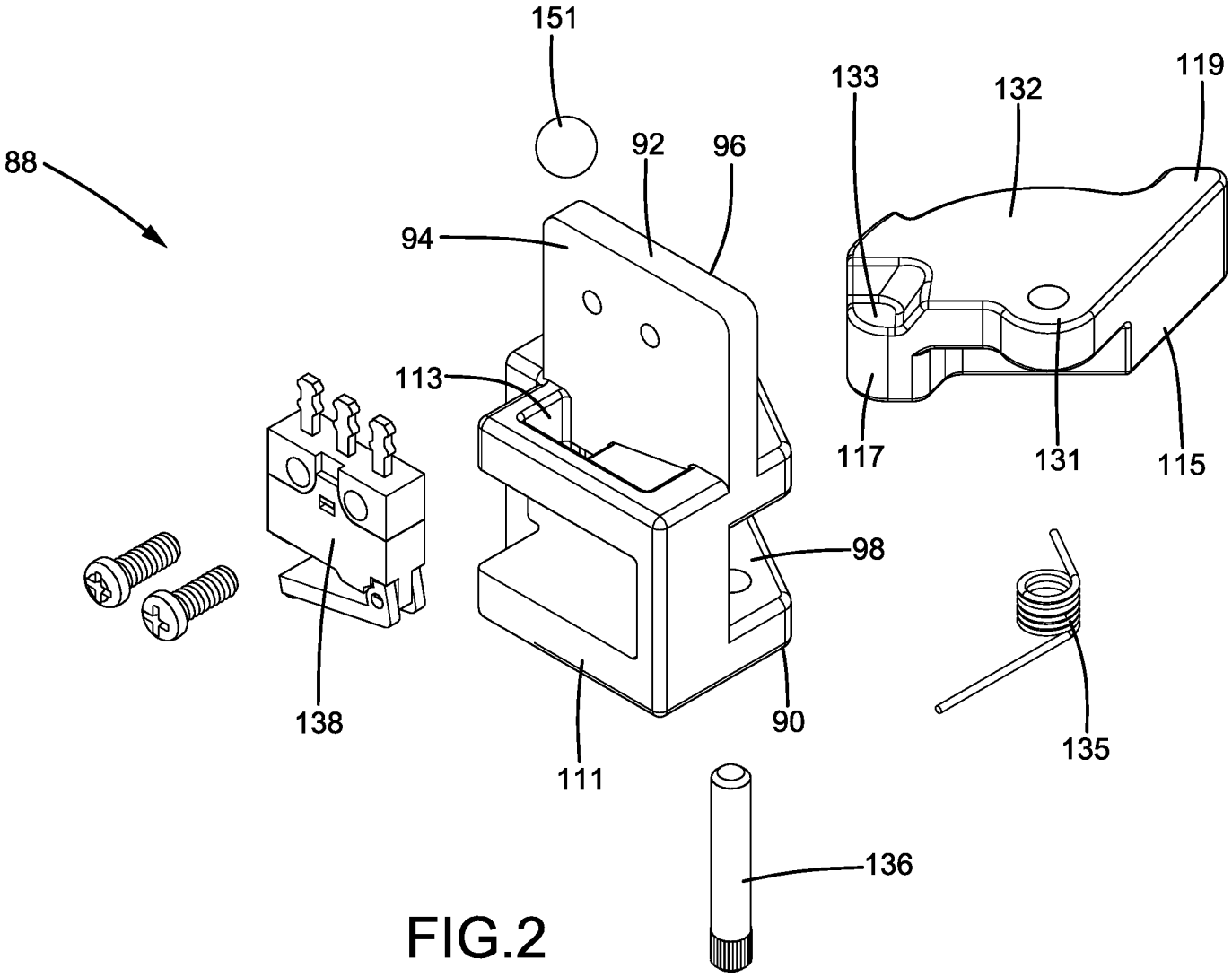
FIG. 2 is an exploded, perspective view of a detecting module of the latch control device of FIG. 1.

With reference to FIGS. 1 and 2, the latch control device 12 further includes a detecting module 88 having a bracket 90. The bracket 90 includes a mounting wall 92 having an inner surface 94 and an outer surface 9. The mounting wall 92 further includes a protrusion 111 formed on the inner surface 94 and a pivotal groove 98 extending from the outer surface 96 to an end face of the protrusion 111. The protrusion 111 includes a movement hole 113 extending from an outer side thereof to the pivotal groove 98. The bracket 90 is securely mounted in the first notch 235 between the two walls 233.

The detecting module 88 further includes an actuation member 115 pivotably connected to the bracket 90. The actuation member 115 includes an inner end 117 and an outer end 119 spaced from the inner end 117. The actuation member 115 further includes a side 132 extending between the inner end 117 and the outer end 119 and a coupling portion 131 disposed between the inner end 117 and the outer end 119. A recess 133 is formed on the side 132 and is located on the inner end 117.

Figure 12:
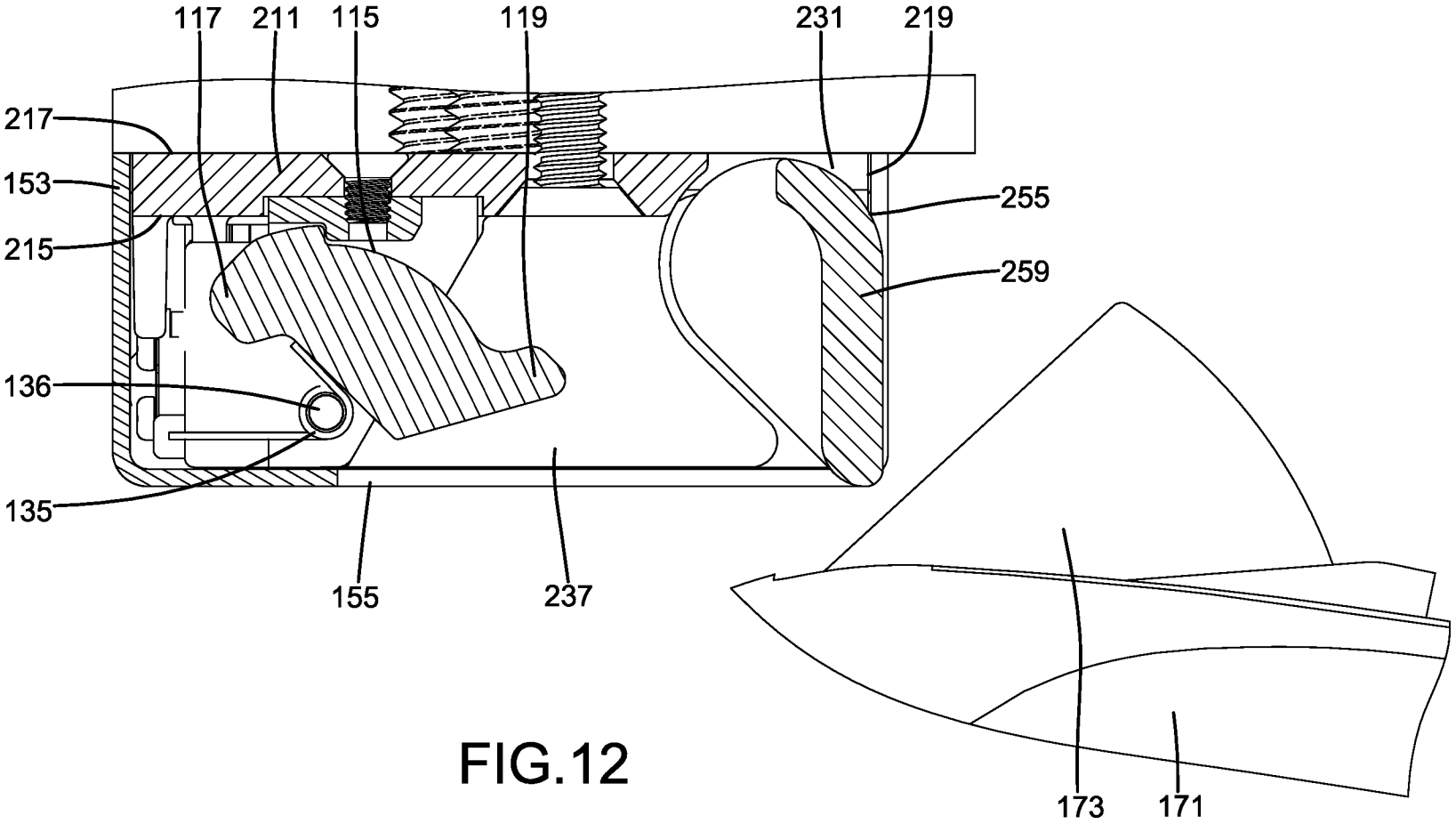
FIG. 12 is a cross sectional view illustrating the latch completely disengaged from a hollow portion.

The actuation member 115 is received in the pivotal groove 98. A pin 136 extends through the coupling portion 131 and the bracket 90 to pivotably connect with the groove 98. The outer end 119 of the actuation member 115 is located outside of the outer surface 96. The inner end 117 is located in the protrusion 111. The actuation member 115 is pivotable about the pin 136 between a door closing position (FIG. 5) and a door opening position (FIG. 12). A bias spring 135 is mounted around the pin 136, is located between the actuation member 115 and the bracket 90, and biases the actuation member 115 to the door opening position.

The detecting module 88 further includes a door closure detecting unit 138 mounted to the inner surface 94 of the mounting wall 92 and located on a side of the movement hole 113. The detecting module 88 further includes a pressing member 151. The actuation member 115 is selectively disposed to actuate or not to actuate the door closure detecting unit 138. In this embodiment, the pressing member 151 is movably received in the movement hole 113 and abuts the side 132 of the actuation member 115. The pressing member 151 is located between the side 132 of the actuation member 115 and the door closure detecting unit 138. Thus, when the actuation member 115 is in the door opening position (not shown), the actuation member 115 is received in the recess 133 of the actuation member 115 and, thus, does not press against the pressing member 151 to actuate the door closure detecting unit 138. On the other hand, when the actuation member 115 is in the door closing position (FIGS. 5 and 6), the pressing member 151 is misaligned from the recess 133 and abuts the side 132. Thus, the actuation member 115 presses against the pressing member 151 to actuate the door closure detecting unit 138.

The latch control device 12 further includes two assembling seats 336 coupled to two outer ends 212 of the connecting seat 211. The two assembling seats 336 are used to securely fix the latch control device 12 to the door frame 175. Particularly, two adjusting screws extend through two elongated holes of the two assembling seats 336 into the door frame 175. Before the two adjusting screws are tightened, the latch control device 12 is adjusted relative to the latch 173 of the door lock 171 mounted to the door 176. Then, the two adjusting screws are tightened to prevent the latch control device 12 from displacing relative to the door frame 175.

Figure 4:
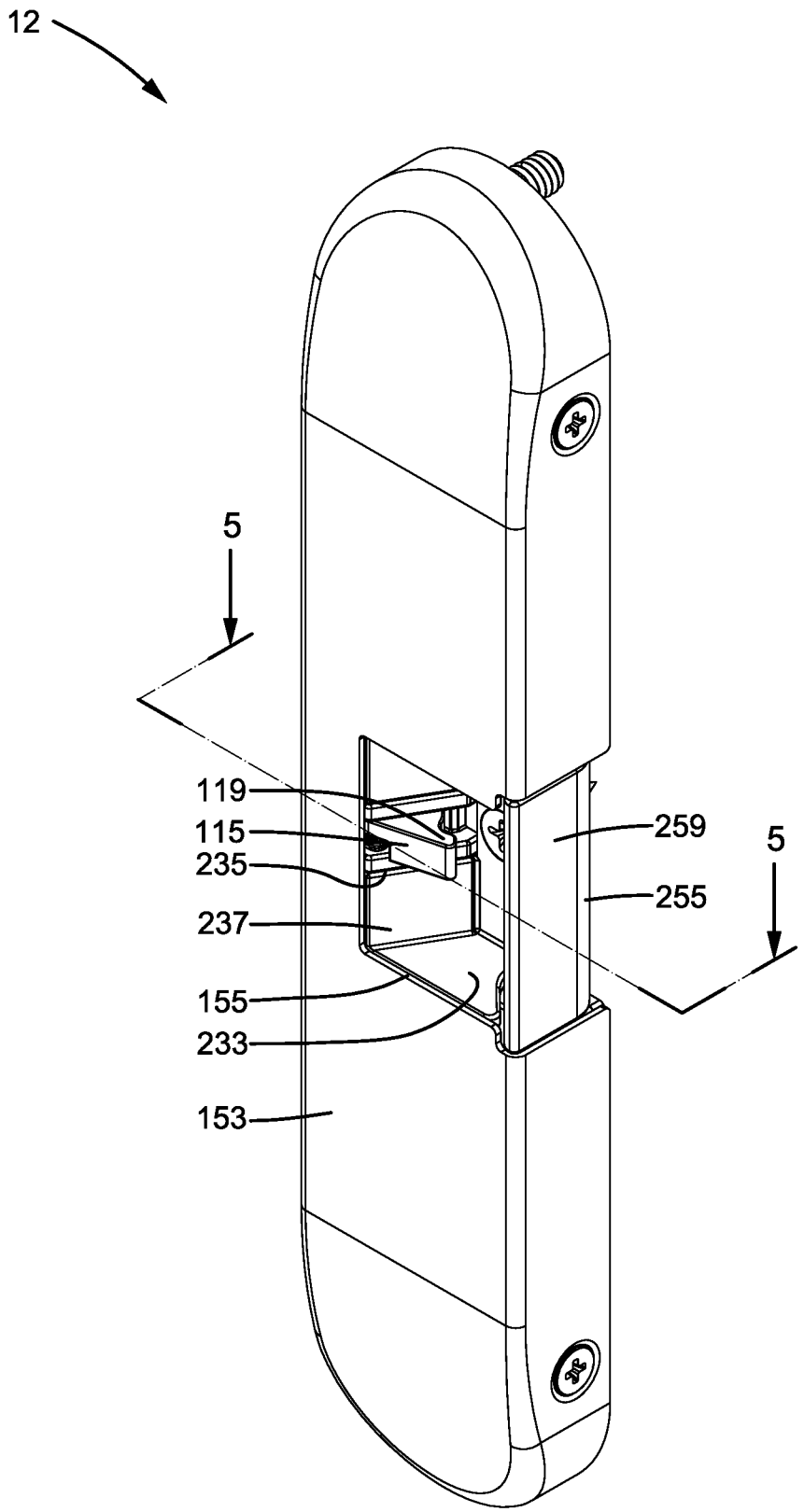
FIG. 4 is a perspective view of the latch control device of FIG. 1.

With reference to FIG. 1, the latch control device 12 includes a casing 153 having an opening 155 which is substantially L-shaped and which extends from an outer end face to a side of the casing 153. The casing 153 is securely mounted to the two assembling seats 336 and covers a periphery of the connecting seat 211, and the opening 155 is aligned with the detecting module 88 and the gate section 259 of the locking member 255. Only the outer end 119 of the actuation member 115 is located in the opening 155 (FIG. 4). When the locking member 255 is in the closure position (FIG. 41, the gate section 259 of the locking member 255 covers a side of the opening 155. When the locking member 255 is in the open position (FIG. 11), the gate section of the locking member 255 does not cover the side of the opening 155.

Now that the basic construction of the latch control device 12 of the present invention has been explained, the operation and some of the advantages of the latch control device 12 can be set forth and appreciated. In particular, for the sake of explanation, with reference to FIGS. 5-7, it will be assumed that the door 176 is in a closed state, and the two driving devices 84 are installed to the normally closed position. In this case, the latch 173 of the door lock 171 extends through the opening 155 into the hollow portion 237 and presses the actuation member 115 to the door closing position (FIG. 5). Thus, the door closure detecting unit 138 is actuated, and the door is detected to be in the closed state. Furthermore, the locking member 255 is in the closure position, and the two driving devices 84 are not electrified, such that the first and second restraining member 291 and 311 are in the stopping position (FIG. 6). Consequently, the two positioning members 273 cannot pivot. Since the limiting ends 275 of the two positioning members 273 respectively abut against outer sides of the two abutting sides 274 of the locking member 255, the locking member 255 cannot pivot from the closure position to the open position (FIG. 7). Consequently, the latch control device 12 is set to a locking state, and the latch 173 of the door lock 171 is restrained in the hollow portion 237 to prevent opening of the door 176.

Figure 10:
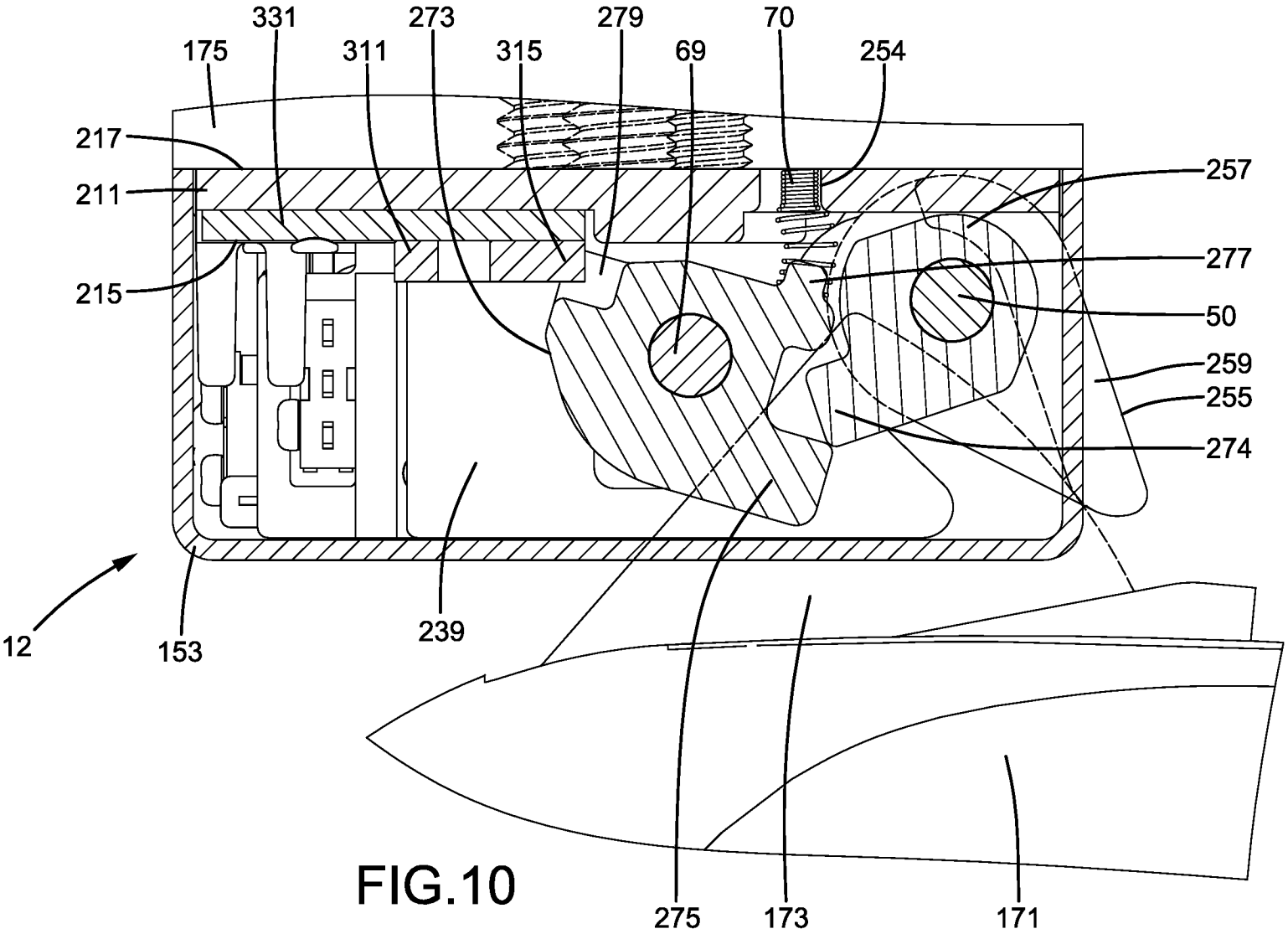
FIG. 10 is a view similar to FIG. 5 with a door opened after the latch control device has been unlocked and with a locking member pivoted by a latch of the door lock.

When it is desired to open the door 176, in an example, a door access card can be used to set the latch control device 12 to an unlocking state, such that the two driving devices 84 are electrified to move the first and second restraining members 291 and 311 from the locking position (FIG. 6) to the unlocking position (FIG. 9). Thus, the two positioning members 273 can be actuated to pivot. After the latch control device 12 has been set to the unlocking state, the locking member 255 is permitted to pivot from the closure position to the open position. Thus, without retracting the latch 173 by operating the door lock 171, the door 176 can be directly pushed to press the latch 173 against the gate section 259 to thereby pivot the locking member 255 (FIG. 10). At the same time, the two positioning members 273 are actuated by the two abutting sides 274 to pivot, such that the locking member 255 pivots from the closure position closing the opening 155 to the open position revealing the opening 155 (FIG. 11). Thus, the latch 173 of the door lock 171 disengages from the hollow portion 237 of the latch control device 12, permitting opening of the door 176.

After the latch 173 of the door lock 171 has completely disengaged from the locking member 255, the return spring 54 returns the locking member 255 to the closure position (FIG. 12). Furthermore, the two driving devices 84 are not electrified to return the first and second restraining members 291 and 311 to the locking position, and the locking member 255 is restrained in the closure position again and, thus, cannot move to the unlocking position. When the locking member 255 is in the closure position, if it is desired to close the door 176, the latch 173 of the door lock 171 is pressed and retracted by the gate section 259 of the locking member 255 until the door 176 is completely closed. The latch 173 of the door lock 171 extends into the hollow portion 237 again, and the door 176 is locked again (see FIG. 5).

Figure 13:
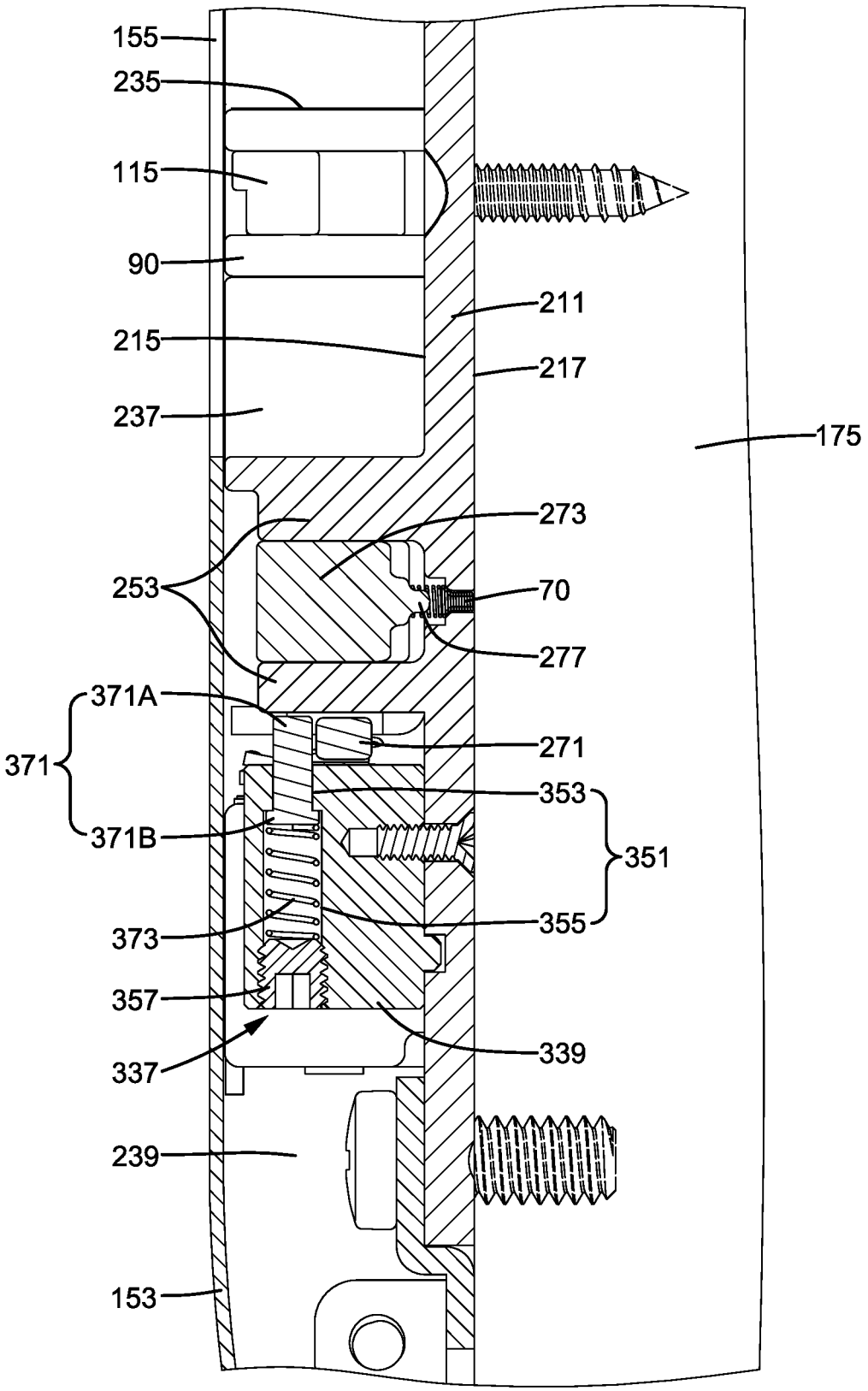
FIG. 13 is a cross sectional view illustrating a pin of the safety pin unit in a position blocking the locking member.

With reference to FIG. 13, in a case that a fire occurs in an area where the latch control device 12 locates, the low melting point member 359 of each of the two safety pin units 337 melts under the high heat at the fire site, whereas each stop pin 371, each spring 373, and each plug 357 do not melt. Thus, each spring 373 pushes the respective stop pin 371 along the second axis until the distal end of the pin body 371A of the respective stop pin 371 extends beyond the respective body 339 into a movement path of a respective arm 271 of the locking member 255. In this state, regardless of the position of the first and second restraining members 291 and 311, the locking member 255 cannot pivot from the closure position to the open position, such that the latch 173 of the door lock 171 is restrained in the hollow portion 237. As a result, the door 176 cannot be opened, reducing the spreading speed of the fire.

The latch control device 12 according to the present invention can proceed with control through an electric measure or technology, such that a conventional mechanical door lock can be used and controlled through the electric measure or technology after cooperating with the latch control device 12 according to the present invention.

The detecting module 88 can be used to detect whether the latch 173 of the door lock 171 is received in the hollow portion 237 to reduce erroneous movement of the latch control device 12.

The connecting seat 211 including the two walls 233 is integrally formed as a monolithic member to increase the strength of the whole connecting seat 211. Thus, the overall structural strength of the latch control device 12 is increased, improving the durability of the latch control device 12.

The two walls 233 and the detecting module 88 together divide the connecting seat 211 into the mounting portion 239 and the hollow portion 237 independent from the mounting portion 239, such that the hollow portion 237 that can be exposed via the opening 155 is separate from the mounting portion 239 in which components are mounted. This can effectively protect the components of the latch control device 12 from being destroyed, increasing the safety.

Each arm 271 of the locking member 255 cooperates with a respective safety pin unit 337 to prevent the locking member 255 from pivoting from the closure position to the open position during a fire, effectively stopping spread of fire.

The U-shaped first and second stop arms 293 and 315 can more stably prevent rotation of the two positioning members 273. Furthermore, even if the first and second stop arms 293 and 315 are located in the locking position and when the door 176 is pushed to impart a larger torque to the two positioning members 273 squeezing the first and second stop arms 293 and 315, the first and second stop arms 293 and 315 are less likely to deform.

Now that the basic teachings of the present invention have been explained, many extensions and variations will be obvious to one having ordinary skill in the art. For example, the latch control device 12 does not have to include the second restraining member 311 and can include only one positioning member 273 without adversely affecting the function of preventing the locking member 255 from pivoting from the closure position to the open position.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A latch control device comprising:

a connecting seat including a first surface and two walls integrally extending perpendicularly from the first surface along a first axis, wherein the two walls are spaced from each other along a second axis perpendicular to the first axis, wherein a first notch and a second notch are formed between the two walls and are spaced from each other along a third axis perpendicular to the first and second axes, wherein a hollow portion is formed at an inner side of the two walls, and wherein a mounting portion is provided at an outer side of the two walls;

a detecting module securely disposed in the first notch, wherein the detecting module includes an actuation member having an outer end located in the hollow portion, wherein the actuation member is configured to detect whether a latch of a door lock is in the hollow portion;

a locking member including an axle coupling portion and an arm extending from the axle coupling portion, wherein the locking member is pivotable about a pivotal axis parallel to the second axis between a closure position closing the second notch and an open position revealing the second notch;

a driving device securely disposed in the mounting portion of the connecting seat;

a first restraining member coupled to the driving device, wherein the first restraining member is actuatable by the driving device between a locking position preventing pivotable movement of the locking member and an unlocking position permitting pivotable movement of the locking member, wherein the latch is restrained in the hollow portion by the first restraining member in the locking position; and a safety pin unit disposed in the mounting portion of the connecting seat, wherein the safety pin unit includes a stop pin, wherein when a fire occurs, the stop pin engages with the arm of the locking member to prevent the locking member from pivoting from the closure position to the open position, and wherein when no fire occurs, the stop pin is spaced from the arm of the locking member, a mounting seat including a first part parallel to the first surface and two second parts extending perpendicularly to the first part, wherein the driving device is securely disposed between the two second parts, wherein the first restraining member is slidably mounted to the first part, wherein the first restraining member further includes a leg extending perpendicularly to a displacement direction of the first restraining member; and a door detecting unit securely disposed on one of the two second parts and located adjacent to the leg, wherein when the first restraining member is in the locking position, the leg is in one of a first mode actuating the door detecting unit and a second mode not actuating the door detecting unit, and wherein when the first restraining member is in the unlocking position, the leg is in another of the first mode actuating the door detecting unit and the second mode not actuating the door detecting unit.

2. The latch control device as claimed in claim 1, wherein each of the two walls has L-shaped cross sections and includes a horizontal section and a vertical section connected to the horizontal section, wherein the first notch is located between the vertical sections of the two walls, and wherein the second notch is located between two ends respectively of the horizontal sections of the two walls distant to the vertical sections.

3. The latch control device as claimed in claim 1, wherein the safety pin unit includes:

a body securely disposed on the first surface of the connecting seat, wherein the body includes a mounting hole extending along the second axis, wherein the mounting hole includes a first hole section and a second hole section having an inner diameter larger than an inner diameter of the first hole section;

a low melting point member received in the second hole section, wherein the low melting point member has an outer diameter larger than the inner diameter of the first hole section and smaller than the inner diameter of the second hole section, wherein a melting point of the stop pin is higher than a melting point of the low melting point member, wherein the stop pin includes a pin body and an enlarged portion on an end of the pin body, wherein the pin body has an outer diameter smaller than the inner diameter of the first hole section, and wherein the enlarged portion has an outer diameter larger than the inner diameter of the first hole section and smaller than the inner diameter of the second hole section;

a plug securely disposed to an end of the second hole section distant to the first hole section; and a spring disposed between the plug and the enlarged portion of the stop pin, wherein the spring biases the stop pin, wherein the arm extends outward in a radial direction of the axle coupling portion, wherein when no fire occurs, the stop pin remains in an inner side of the body, and wherein when the low melting point member melts under a fire, the spring biases the pin body of the stop pin to extend beyond the body to engage with the arm.

4. The latch control device as claimed in claim 1, wherein the detecting module includes:

a bracket securely disposed in the first notch between the two walls, wherein the bracket includes a mounting wall;

the actuation member pivotably connected to the mounting wall of the bracket, wherein the actuation member includes an inner end and an outer end, wherein the actuation member is pivotable between a door closing position and a door opening position; and a door closure detecting unit mounted to a side of the mounting wall, wherein the inner end of the actuation member is configured to actuate the door closure detecting unit, wherein when the actuation member is in the door closing position, the inner end of the actuation member is in one of a first mode actuating the door closure detecting unit and a second mode not actuating the door closure detecting unit, and wherein when the actuation member is in the door opening position, the inner end of the actuation member is in another of the first mode actuating the door closure detecting unit and the second mode not actuating the door closure detecting unit.

5. The latch control device as claimed in claim 1, further comprising a positioning member, wherein the connecting seat includes first and second pivotal portions formed on the first surface and located in the mounting portion, wherein the locking member includes an abutting side on the axle coupling portion, wherein the axle coupling portion is pivotably connected to the first pivotal portion, wherein the positioning member is pivotably connected to the second pivotal portion, wherein the positioning member includes a limiting end and a groove spaced from the limiting end in a circumferential direction about a pivotal axis defined by the second pivotal portion, wherein the limiting end abuts against the abutting side, wherein the first restraining member includes a first stop arm extending along the third axis, wherein when the first restraining member is in the locking position, the first stop arm is spaced from the groove along the second axis and is located between the positioning member and the mounting seat along the second axis, such that the positioning member is not pivotable to prevent the locking member from pivoting from the closure position to the open position, and wherein when the first restraining member is in the unlocking position, the first stop arm is aligned with the groove along the second axis, and the positioning member is pivotable to allow pivotal movement of the locking member from the closure position to the open position.

6. The latch control device as claimed in claim 5, further comprising a bias spring disposed between the positioning member and the connecting seat, wherein the connecting seat further includes a slot defined in the first surface and extending along the third axis, wherein the positioning member further includes a pressing end located between the groove and the limiting end in the circumferential direction about the pivotal axis defined by the second pivotal portion, wherein an end of the bias spring is coupled with the pressing end, wherein another end of the bias spring is received in the slot, and wherein when the positioning member pivots, the end of the bias spring slides in the slot along the third axis.

7. The latch control device as claimed in claim 5, wherein the first stop arm is U-shaped and includes two distal ends, wherein when the first restraining member is in the locking position, the two distal ends of the first stop arm are misaligned from the groove of the positioning member along the second axis and are located between the positioning member and the mounting seat along the first axis, and wherein when the first restraining member is in the unlocking position, one of the two distal ends of the first stop arm is aligned with the groove along the second axis, and another of the two distal ends of the first stop arm is located on an outer side of the positioning member.

* * * * *